United States Patent [19]

Blomqvist et al.

[11] 4,326,340

[45] Apr. 27, 1982

[54] DEVICE FOR AIMING OF A WEAPON

[75] Inventors: Åke Blomqvist; Kurt Dahlberg, both of Karlskoga, Sweden

[73] Assignee: Aktiebolaget Bofors, Bofors, Sweden

[21] Appl. No.: 974,581

[22] Filed: Dec. 29, 1978

[30] Foreign Application Priority Data

Jan. 18, 1978 [SE] Sweden ..... 78006251

[51] Int. Cl.[3] ..... F41G 3/08; G06F 15/58

[52] U.S. Cl. ..... 33/238; 89/41 B; 89/41 AA

[58] Field of Search ..... 33/235, 236, 237, 238, 33/239, 240, 233, 227, 278; 89/41 AA, 41 M, 41 B

[56] References Cited

U.S. PATENT DOCUMENTS

| | | | |
|---|---|---|---|
| 2,660,794 | 12/1953 | Goertz et al. | 33/239 |
| 3,011,108 | 11/1961 | Blomqvist | 33/237 X |
| 3,685,159 | 8/1972 | Erhard | 33/238 |
| 3,727,514 | 4/1973 | Maxime et al. | 33/238 |
| 3,766,826 | 10/1973 | Salomonsson | 89/41 B |
| 4,004,729 | 1/1977 | Rawicz et al. | 33/238 |

*Primary Examiner*—William D. Martin, Jr.
*Attorney, Agent, or Firm*—Pollock, Vande Sande & Priddy

[57] ABSTRACT

The position, velocity or acceleration of a weapon in traverse and/or elevation is maintained constant at its value just prior to firing of the weapon, for a short period including the firing, thereby minimizing operator errors in aiming caused by smoke and vibration.

20 Claims, 4 Drawing Figures

DEVICE FOR AIMING OF A WEAPON

BACKGROUND OF THE INVENTION

The present invention relates to a device for aiming of a weapon, for instance an anti-aircraft gun, at a moving target which is to be fired upon, comprising a sight arranged in connection with the weapon, in which an operator can observe the target, and at least one aiming system with the aid of which the operator can aim the weapon at the target observed.

When firing upon a moving target with a weapon of the kind described above, an operator keeps the line of sight of the sight constantly aimed at the moving target, at the same time as he guides the weapon so that the firing direction of the weapon moves in conformity with the line of sight. With a system in which the sight is mounted on the weapon which can be aimed, the aiming of the line of sight of the sight at the target usually takes place by aiming of the weapon itself. When the operator during the aiming is located on the gun mounting, problems arise due to the fact that the operator is annoyed by smoke and shaking when the firing commences, so that he no longer can perform his task with accuracy. Tests have shown that only the first few rounds in a salvo can be expected to take effect, while the subsequent rounds in the salvo will have such a great miss distance that no effect can be expected. Attempts have been made to solve this problem through the introduction of feed-back control according to which it is determined in a computer how the sight on the gun should be aimed to continue to track a target which moves along a rectilinear path. However, such equipment is complicated and costly. Moreover, it requires, inter alia, a knowledge of the range to the target, which otherwise is not needed in certain cases with less complicated fire control sights.

SUMMARY OF THE INVENTION

The purpose of the present invention is to achieve a device of the kind mentioned above at a low cost, and which makes it possible to fire comparatively long salvos at a moving target, with good effect. The invention is mainly characterized in that the aiming system comprises means which at the firing of the weapon are arranged to carry out a switching in the aiming system so that the angular position of the weapon or one or a plurality of its position derivatives are kept constant during the time the firing is taking place.

If the device comprises an aiming system for aiming the weapon in traverse, for instance, the acceleration in traverse, the velocity in traverse, or the angular position in traverse can be kept constant during the time the firing is taking place. If the device comprises an aiming system for aiming the weapon in elevation, the velocity in elevation or the angular position in elevation can be kept constant during the time the firing is taking place.

Brief Description of the Drawings

In the following, the invention will be described in more detail with reference to the accompanying drawings, in which.

DETAILED DESCRIPTION OF THE PREFERRED EMBODIMENTS

Figure 1:
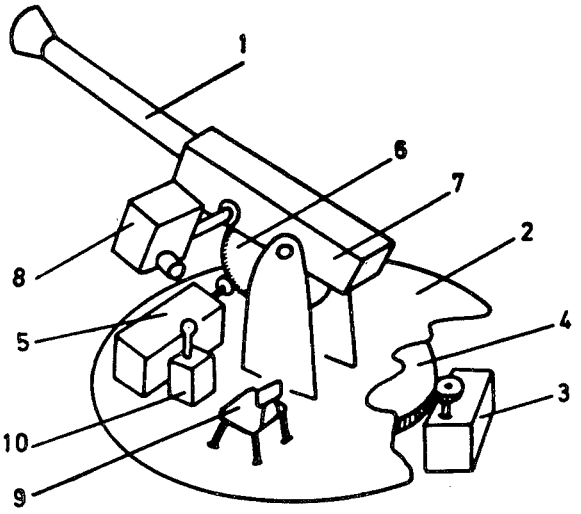
FIG. 1 shows schematically the invention in connection with an anti-aircraft gun.

The anti-aircraft gun illustrated as an example and only schematically in FIG. 1 comprises a barrel 1 which in a conventional way is supported so that it can be elevated on an upper mounting 2. The upper mounting 2 can be traversed with the aid of a servomotor 3 which engages in the gear ring 4. A part of the upper mounting 2 has been cut away to show the positioning of the servomotor 3 and the gear ring 4. Elevation of the gun takes place with the aid of a servomotor 5 placed on the upper mounting 2 in position to engage a gear arc 6 on the elevating mass 7.

The anti-aircraft gun also comprises a sight 8, which is mounted on the elevating mass 7. The sight is only shown schematically in the drawing, as its configuration has no significance, in principle, for the invention. The sight can comprise, for instance, a conventional optical sight, a radar sight or a laser sight. The only essential thing is that the gun operator can continuously judge the position of the line of sight of the sight in relation to a target observed with the sight. A gun operator sitting on a seat 9, placed on the side of the gun on the upper mounting 2, with the aid of an aiming lever 10 can actuate the two servomotors 3 and 5 so that the gun is elevated and traversed. Thus, he tracks the target, with an appropriate angle of aim-off and tangent elevation, with the aid of the sight 8.

Figure 2:
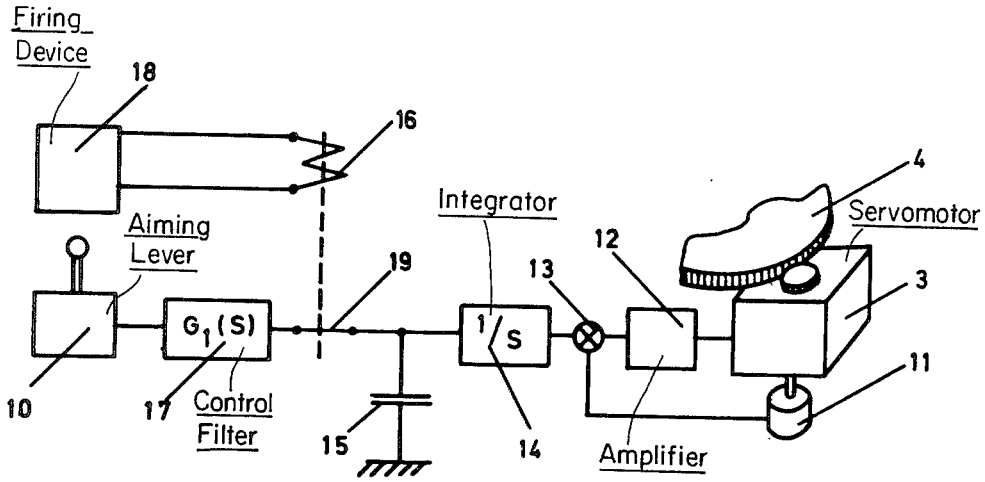
FIG. 2 shows the design of the traversing system of a device according to the invention.

FIG. 2 shows an example of how the traversing system can be designed with a device according to the invention. The figure shows the servomotor 3 which engages in the gear ring 4 for traversing of the upper mounting of the gun. A tachometer generator 11 is connected to the servomotor 3, and which in a conventional way generates an electric signal proportional to the angular velocity in traverse of the barrel 1 and therewith the direction of fire. The servomotor is controlled by an amplifier 12 which is connected with feedback to the tachometer generator 11 via a summation means 13 which in turn is fed from an integrator 14. On the input of the integrator a so-called sample and hold circuit, consisting of a capacitor 15 and a relay 16 is connected. Traversing takes place with the aid of the aiming lever 10, which is connected with the sample and hold circuit via a control filter 17. The control filter comprises an electric circuit which is designed in such a way that its transmission function has such properties that the gun operates task is made as easy as possible. An example of an appropriate design of the control filter for tracking rapid aerial targets is $$G_1(s) = \frac{1 + As + Bs^2}{(1 + Cs)^2}$$

in which s designates the Laplace operator and A, B and C are constants, with values, for instance, of A=1 Sec.; B=0.25 Sec.$^2$ and C=0.05 Sec. The relay 16 is connected to a firing circuit 18, which emits a signal when the gun is fired, and the relay then breaks the circuit at the switching means 19 in the control circuit.

Figure 3:
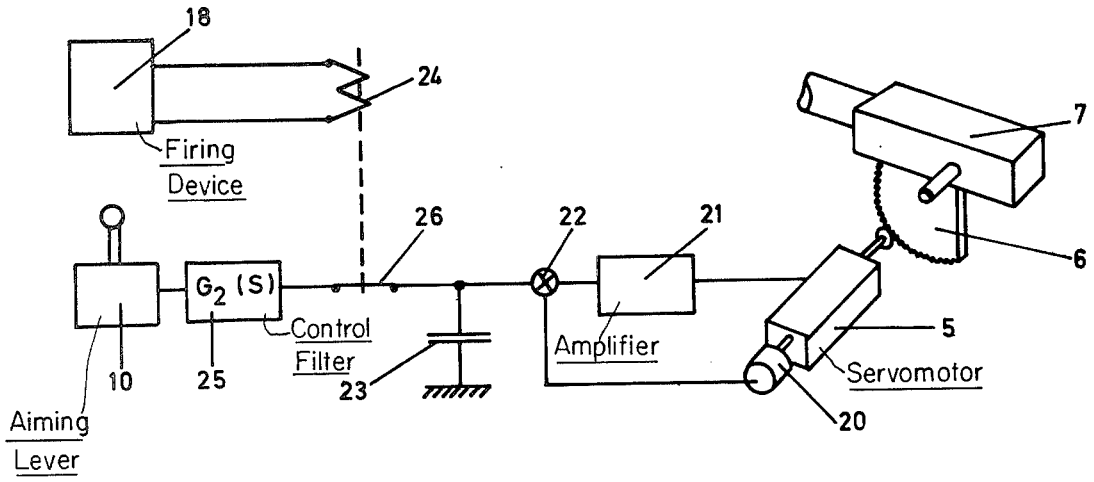
FIG. 3 shows the design of the elevating system.

FIG. 3 shows an example of the design of the elevating system with a device according to the invention. The servomotor 5 coacts with the gear arc 6 on the elevating mass 7 of the gun. As in the case of the servomotor 3 for traversing, a tachometer generator 20 is connected to the servomotor 5, and which generates an electric signal proportional to the angular velocity in elevation of the barrel 1 and therewith the direction of fire. The servomotor 5 is controlled by an amplifier 21, which is connected with feed-back to the tachometer generator 20 via a summation means 22. On the input of the summation means a sample and hold circuit, consisting of a capacitor 23 and a relay 24, is connected. The gun operator elevates the gun with the aid of the aiming lever 10, which is connected with the sample and hold circuit via a control filter 25. The control filter comprises an electric circuit which, for instance, has the transmission function $$G_2(s) = \frac{1 + Ds}{1 + Cs}$$

in which s is the Laplace operator and D and C are constants with values, for instance of D=0.5 Sec. and C=0.05 Sec. The relay 24 is connected to the firing circuit 18, which emits a signal when the gun is fired, and the relay then breaks the circuit at the switching means 26 in the control circuit.

The device described above functions in the following way. The gun operator aims the gun with the aid of the aiming lever 10 and tracks the target with the sight 8. It is assumed that the sight 8 is arranged in an appropriate, known way for calculating or estimating the angle of aim-off and the tangent elevation. The firing takes place with the aid of the firing device 18, which at the same time influences the relays 16 and 24 in the sample and hold circuits, so that the aiming lever 10 is disconnected from the two control systems. The gun then continues to move with a constant acceleration in traverse and constant velocity in elevation. Calculations have shown that it is then possible to maintain accurate tracking of the target and therewith firing with good effect during approximately 2 Secs. when rapid targets moving with a speed of a magnitude of 300 m/Sec. and at a range of 1000–2000 meters, are involved, and during a longer time when slower targets or targets at a longer range are involved.

Figure 4:
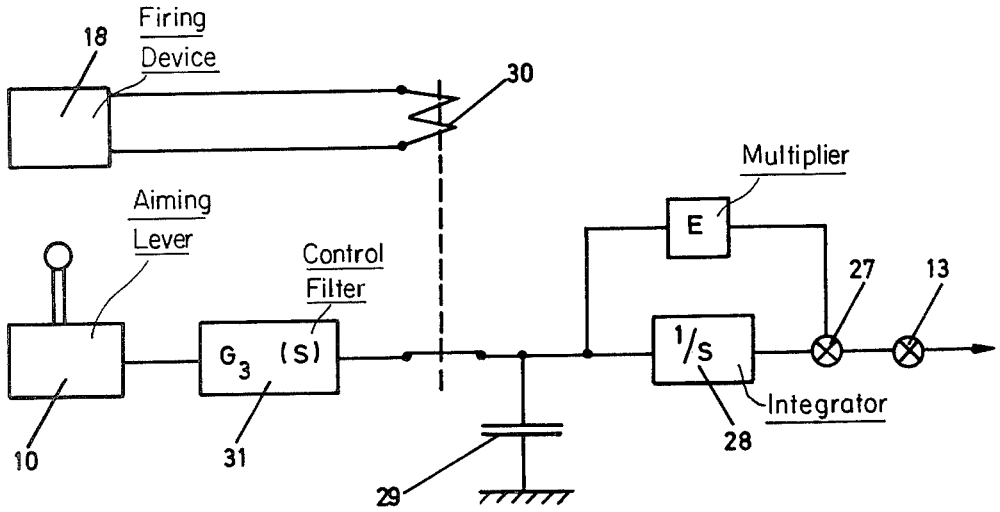
FIG. 4 shows an alternative design of the traversing system of the device.

The device described above can be modified in various ways without deviating from the concept of the invention. An example of a different design of the control system for the control in traverse is shown in FIG. 4. The system from the summation means 13 to the gun is identical to the system according to FIG. 2, and has therefore not been shown in FIG. 4. However, the system between the aiming lever 10 and the summation means 13 has been modified in such a way that a further summation means 27 has been connected to the input of the summation means 13. The summation means 27 forms the sum of the output signal from an integrator 28 and the input signal to this integrator multiplied by a constant E. Analagously with the control system according to FIG. 2, a sample and hold circuit, consisting of a capacitor 29 and a relay 30 is connected to the input of the integrator 28. The aiming lever 10 is connected to this sample and hold circuit via a control filter 31, with the transmission function $$G_3(s) = \frac{1 + As}{1 + Cs}$$

in which s is the Laplace operator and the constants E, A and C have, for instance, the values E=1 Sec.; A=0.5 Sec. and C=0.05 Sec.

The above-mentioned control filter dimensions are examples only, and the most appropriate design is influenced by the other properties of the system, such as the magnification of the sight, the properties of the aiming lever, the band width of the servo systems for control in elevation and traverse etc.

The design indicated of the system is optimized for combatting rapid aerial targets. When combatting slow targets, for instance helicopters and ground targets, it can be advisable to eliminate the integrators 14 and 28, and the traversing system will then have properties similar to those of the elevating system described in FIG. 3. It is also conceivable to replace the tachometer generator 11 in FIG. 2 and/or 20 in FIG. 3 with an angle transmitter, for instance a potentiometer, and then, when firing, the traversing and/or elevating position, respectively, may be kept constant.

In cases when the weapon is installed on a moving base, for instance on a ship or a land vehicle, the angular position of the weapon is to be kept constant in relation to a space-fixed co-ordinate system, and the tachometer generators 11 and 20 should then be replaced by speed gyros which are installed on the elevating mass or the traversing parts of the weapon.

We claim:

1. Apparatus for aiming a weapon which is movable in elevation and traverse, said apparatus comprising:

sight means operatively associated with the weapon for enabling the operator to observe a moving target;

aiming means operatively associated with the weapon for enabling the operator to aim the weapon at the target, said aiming means comprising means for adjusting the angular position and the angular velocity of the weapon in elevation, said adjusting means comprising a gear arc attached to the elevating portion of the weapon, a first servomotor for rotating said gear arc to elevate the weapon, a first amplifier having its output connected to said first servomotor, a first angular position or angular velocity generator driven by said first servomotor and connected at its output via a first summing means to the input of said first amplifier, and a first control filter connected at its output to said first summing means;

means for firing the weapon; and means responsive to said firing means for holding constant, during the time firing is taking place, one of the angular position or the angular velocity in elevation which was in existence for the weapon just prior to actuation of said first means, said holding means comprising first sample and hold means operated by said firing means and connected between said first control filter and said first summing means for disconnecting said first control filter from said first summing means during the time firing is taking place.

2. Apparatus according to claim 1, wherein said holding means also holds constant the acceleration in traverse during the time firing is taking place.

3. Apparatus according to claim 1, wherein said holding means also holds constant the velocity in traverse during the time firing is taking place.

4. Apparatus according to claim 1, wherein said holding means also holds constant the angular position in traverse during the time firing is taking place.

5. Apparatus according to claim 1, wherein said weapon is arranged on a moving base such as a ship or a land vehicle, said holding means then serving to hold constant, with respect to a spaced-fixed coordinate system, either the position or velocity in elevation of the weapon, during the time firing is taking place.

6. Apparatus according to claim 2, wherein said aiming means further comprises a ring gear attached to a mounting for the weapon, a second servomotor for rotating said ring gear to traverse the weapon, a second amplifier having its output connected to said second servomotor, a second angular position or angular velocity generator driven by said second servomotor and connected at its output via a second summing means to the input of said second amplifier, a second control filter connected at its output to said second summing means; and said holding means further comprises second sample and hold means operated by said firing means and connected between said second control filter and said second summing means for disconnecting said second control filter from said second summing means during the time firing is taking place.

7. Apparatus according to claim 6, wherein said second generator is an angular velocity generator, further comprising an integrator connected at its output to said second summing means and at its input to said second control filter, said second sample and hold means being connected between said second control filter and said integrator.

8. Apparatus according to claim 7, further comprising a third summing means connected between said second summing means and said integrator to receive an input from said integrator and means for directing another input to said third summing means, said another input being the input signal to said integrator multiplied by a constant.

9. Apparatus according to claim 6, wherein each of said sample and hold means comprises a capacitor and a relay, each of said relays being connected to said firing means to disconnect its respective control filter during firing.

10. Apparatus according to claim 1, wherein said first sample and hold means comprises a capacitor and a relay, said relay being connected to said firing means to disconnect said first control filter during firing.

11. Apparatus according to claim 9, wherein each said relay opens and closes a switch connected to the output of its respective control filter.

12. Apparatus according to claim 10, wherein said relay opens and closes a switch connected to the output of said first control filter.

13. Apparatus for aiming a weapon which is movable in elevation and traverse, said apparatus comprising:

sight means operatively associated with the weapon for enabling the operator to observe a moving target;

aiming means operatively associated with the weapon for enabling the operator to aim the weapon at the target, said aiming means comprising means for adjusting the angular position, the angular velocity and the angular acceleration of the weapon in traverse, said adjusting means comprising a ring gear attached to a mounting for the weapon, a first servomotor for rotating said ring gear to traverse the weapon, a first amplifier having its output connected to said first servomotor, a first angular position or angular velocity generator driven by said first servomotor and connected at its output via a first summing means to the input of said first amplifier, and a first control filter connected at its output to said first summing means;

means for firing the weapon; and means responsive to said firing means for holding constant, during the time firing is taking place, one of the angular position, the angular velocity or the angular acceleration in traverse which was in existence for the weapon just prior to actuation of said firing means, said holding means comprising first sample and hold means operated by said firing means and connected between said first control filter and said first summing means for disconnecting said first control filter from said first summing means during the time firing is taking place.

14. Apparatus according to claim 13, wherein said first generator is an angular velocity generator, further comprising an integrator connected at its output to said first summing means and at its input to said first control filter, said first sample and hold means being connected between said first control filter and said integrator.

15. Apparatus according to claim 13, wherein said holding means also holds constant the velocity in elevation during the time firing is taking place.

16. Apparatus according to claim 13, wherein said holding means also holds constant the angular position in elevation during the time firing is taking place.

17. Apparatus according to claim 13, wherein said weapon is arranged on a moving base such as a ship or a land vehicle, said holding means then serving to hold constant, with respect to a space-fixed coordinate system, one of the angular position, velocity or acceleration in traverse of the weapon, during the time firing is taking place.

18. Apparatus according to claim 13, further comprising a second summing means connected between said first summing means and said integrator to receive an input from said integrator and means for directing another input to said second summing means, said another input being the input signal to said integrator multiplied by a constant.

19. Apparatus according to claim 13, wherein said first sample and hold means comprises a capacitor and a relay, said relay being connected to said firing means to disconnect said first control filter during firing.

20. Apparatus according to claim 19, wherein said relay opens and closes a switch at the output of said first control filter.

* * * * *